United States Patent [19]

Funk

[11] Patent Number: 4,555,279

[45] **Date of Patent: * Nov. 26, 1985**

[54] LOW DETONATION VELOCITY EXPLOSIVE COMPOSITION

[75] Inventor: Richard L. Funk, Hackettstown, N.J.

[73] Assignee: Hercules Incorporated, Wilmington, Del.

[ * ] Notice: The portion of the term of this patent subsequent to Dec. 25, 2001 has been disclaimed.

[21] Appl. No.: 661,493

[22] Filed: Oct. 16, 1984

Related U.S. Application Data

[63] Continuation-in-part of Ser. No. 597,311, Apr. 5, 1984, Pat. No. 4,490,196.

[51] Int. Cl.[4] ..... C06B 25/34

[52] U.S. Cl. ..... 149/92; 149/88; 149/95; 149/97; 149/101; 102/313

[58] Field of Search ..... 149/88, 92, 101, 95, 149/97; 102/313

[56] References Cited

U.S. PATENT DOCUMENTS

| | | | |
|---|---|---|---|
| 2,709,130 | 5/1955 | Rinkenbach | 52/11 |
| 2,766,828 | 10/1956 | Rachford, Jr. | 166/36 |
| 2,892,405 | 6/1959 | Chestnut | 102/23 |
| 3,239,395 | 3/1966 | Laurence | 149/89 |
| 3,423,256 | 1/1969 | Griffith | 149/2 |
| 3,630,284 | 12/1971 | Fast et al. | 166/299 |
| 3,819,429 | 6/1974 | Schaefer | 149/21 |
| 3,894,894 | 7/1975 | Elrick | 149/19.4 |
| 4,025,370 | 5/1977 | Csanady et al. | 149/92 |
| 4,081,031 | 3/1978 | Mohaupt | 166/299 |
| 4,239,561 | 12/1980 | Camp et al. | 149/19.8 |
| 4,352,699 | 10/1982 | Zeigler, Jr. | 149/109.6 |
| 4,371,409 | 2/1983 | Cartwright et al. | 149/94 |
| 4,420,350 | 12/1983 | Camp et al. | 149/98 |
| 4,490,196 | 12/1984 | Funk | 149/94 X |

FOREIGN PATENT DOCUMENTS 1584931 2/1981 United Kingdom .

OTHER PUBLICATIONS

J. Petroleum Technology, R. A. Schmidt, Jul. '81, pp. 1305 et seq.

"History of the Explosives Industry in America", Van Gelder and Schlatter, Co. Univ. Press 1927, pp. 3961 et seq., 1024 et seq.

*Primary Examiner*—Stephen J. Lechert, Jr.

[57] ABSTRACT

A liquid-type low detonation-velocity explosive composition having reduced shock energy with unhindered bubble energy, and a method for minimizing damage from explosive well stimulation procedure by use of such composition.

30 Claims, No Drawings

LOW DETONATION VELOCITY EXPLOSIVE COMPOSITION

This invention is a continuation-in-part of U.S. Ser. No 597,311, filed on Apr. 5, 1984 now U.S. Pat. No. 4,490,196 and relates to a class of low detonation velocity explosive compositions exhibiting a small shock wave component based on total energy release. Such compositions have been found suitable for well stimulation, inclusive of water, oil, and gas wells since they maximize fissurization while minimizing well bore damage and compression of the surrounding area.

BACKGROUND

While the technique of oil well stimulation or revival through the use of explosives such as nitroglycerin is at least 120 years old, water well stimulation using this general technique is even older, and the results obtained still remain speculative in nature, with success being far from assured. This is due mainly to a lack of knowledge concerning the surrounding geological structure at the active level or "pay zone" of deep wells, and also due to difficulty in assuring use of a correct amount of explosive to enlarge the well bore and uniformly open the surrounding geological formation, rather than compacting such surrounding formation and thereby decreasing its permeability to flow. In addition, it is very desirable if the amount of debris in the well bore can be minimized to avoid expensive follow up "well bailing" procedures.

Insofar as the explosives are concerned, it has been assumed, historically, that controlled amounts of high explosive material, such as nitroglycerin and TNT can best do the job. This assumption is undoubtedly due to extensive field testing and general experience with such explosives for shallow excavation such as quarry, and road cut work.

Such assumption is found to be incorrect, however, when detonation is carried out in a deep well with little overburden movement. Here, high explosives cause the nearby rock to yield (i.e. plastic flow) and the surrounding area to severely compact and then partly unload elastically, resulting in a somewhat larger well bore cavity surrounded by a residual stress field or stress cage in which deformed rock and the fines produced by the explosion are sufficiently compressed and impermeable to seal off or severely restrict the flow of gases or liquids into or out of the surrounding formation. This result clearly frustrates the purpose of the "shoot."

By way of further explanation, the detonation pressures of most high explosives are found to be far in excess of the yield stresses of the surrounding rock and, therefore, capable of causing a substantial amount of the above-described irreversible plastic deformation of the surrounding rock.

In the area further away from the well bore, however, the amplitude of the stress wave caused by the explosion is mitigated by geometrical divergence effects and by other dissipating factors. Here the rock is initially displaced, and then tends to return to its original position. Such return is prevented, in part, by the permanently deformed area surrounding the well bore to create the above-stated region of residual stress. In the absence of such a residual stress field and containment of the explosive gases, the resulting gases would be expected to move into surrounding fractures and further extend them on a 360° range into the surrounding untouched formation.

Formation of the above-described phenomenon can occur with the use of high explosives of widely varying charge sizes.

The stated problem has not been solved but has been minimized with varying degrees of success, depending upon (a) the surrounding geological formation, (b) the amount and placement of charge(s), and (c) the spontaneous opening up of leakage pathways into surrounding formations due to subsequent spontaneous break up of the newly formed stress field. The latter, of course, is not predictable or expected in all formations.

Placement of a charge below the "pay zone" and through use of the well bore itself as a gas or liquid flow pathway into the "pay zone" has provided some measure of control and predictability in well shooting, the most promising approach, however, appears to be achieved by charge shaping, coupled with the use of specialized propellant-type explosives which produce a maximum pressure less than the yield stress of the surrounding rock. Such compounds produce a flame front traveling more slowly than the speed of sound, and the underlying chemical reaction lags behind the flame front; as opposed to high energy explosives, which have a detonation wave which travels faster than sound and the bulk of the chemical energy is quickly released behind the detonation wave shock front. In both cases, the total chemical energy released is approximately equivalent or slightly less than that experienced with a propellant-type explosive.

It is an object of the present invention to obtain an explosive composition which possesses desired propellant-type characteristics and which can successfully induce multiple fractures around a selected part of a well bore hole, while minimizing well bore hole damage and formation of a residual stress field.

It is a further object to fully utilize the benefits of a propellant-type pressure pattern while maintaining the gas generating properties of a high explosive such as (a) low peak pressures, (b) a shock energy comparable to a propellant deflagration, (c) gas formation comparable to that obtained by an explosive detonation, and (d) a substantial total energy output while still retaining cost, convenience, and packing efficiency of art-recognized high explosive compositions.

It is a still further object of the present invention to minimize formation of a residual stress field and well bore hole damage during a well shoot operation.

THE INVENTION

The above objects are achieved in accordance to the present invention by placing and detonating at least one explosive charge of low detonation velocity of a composition comprising (a) at least one component of the group $ROOC\text{-}(A)\text{-}COOR^{1}$, $[R''\text{-}(A)\text{-}O]_3[PO_4]$, $R''\text{-}(A)\text{-}[NO_2]_2$, and $R'''\text{-}(Ac)_m$ in which R and $R^1$ are individually defined as a lower alkyl group, inclusive of a 4–8 carbon alkyl group such as butyl and octyl groups; A is defined as the nucleus of a substituted or unsubstituted aromatic group such as a phenyl or naphthyl group, including phenylene, methylphenylene and napthylene moieties; R″ is an alkyl group of 1–2 carbon atoms such as a methyl or ethyl group; R‴ is an alkyl group of 3–8 carbon atoms such as a propyl or octyl group, and may also contain 0–2 hydroxyl substituent groups; Ac is defined as an acetoxy group; and m is a whole number of 1–3;

(b) a component comprising at least one member of the group consisting of metriol trinitrate, diethylene glycol dinitrate, and nitroglycerin, including for purposes of the present invention, a ratio of about 0–100:0–100:0–100 parts by weight and preferably 40–60 to 60–40 parts by weight of metriol trinitrate to diethylene glycol dinitrate; and (c) a stabilizing amount of at least one organic stabilizer component including up to about 3% by weight exemplified by soluble 2-nitro-diphenylamine or diethyl-diphenylurea (Ethyl Centralite), A useful ratio by weight of (a) to (b) components, for purposes of the present invention, is found to be about 9–45 to 91–55 inclusive of 9–20 to 91–80, and preferably 9.8–18.3 to 90.2–81.7, to obtain the desired ratio between released explosive energy expressed as shock wave (S) and explosive energy expressed as gas or bubble expansion (G). Optimally the ratio of (S)-to-(G) for present purposes is kept within the range of about 5–45% (S)-to-95–55%(G) and preferably 20–30%(S)-to-80–70% (G) to assure a maximum area of fracture with minimum amount of well damage, and minimum formation of surrounding impermeable compacted material (i.e. Residual Stress Field).

Low detonation velocity composition(s) in accordance with the present invention, when utilized in accordance with normal art-recognized well-shooting practices and equipment, are found to possess a slow detonation velocity within a range of about 1200 meters/second to about 2500 meters/second and, preferably, within a range of about 1200–2200 meters/second, and are capable of obtaining the above-noted breakdown between shock wave energy(S) and gas expansion energy(G). Such compositions are found to be particularly effective when used at depths in excess of 200 ft., where overburden movement is minimal or nonexistent. Such can be successfully used, for instance in combination with tamping material such as sand or gravel, which are capable of confining the expanding gases for a period up to about 30 or more seconds and then expelled from the well. Optimally, such use involves a water head pressure of about 400–600 psi or higher and at an operating temperature range varying from about 11O° F. to about −22° F.

Suitable components for purposes of the present invention are obtainable as follows:

(a) Ester components such as a di-lower alkyl ester of terephthalic, isophthalic, homophthalic acid and naphthalene 1,4 dicarboxylic acid can be obtained by direct reaction of the dicarboxy acid with a desired lower alkanols such as a 4–8 carbon alkanol to obtain symetrical and non-symetrical esters such as the octyl/octyl and butyl/octyl ester.

The above reaction can be conveniently carried out, for instance, by direct refluxing of phthalic anhydride with butanol, octanol or combinations thereof in desired amounts.

Such esters are obtainable commercially from Reichhold Chemicals, Inc. and U.S. Steel, Chemical Division, and tricresyl phosphate can be synthesized, for instance, by direct nitration of a corresponding Cresol intermediate using art-recognized processes.

Corresponding polyhydroxy esters of natural oils and such as triacetin are also obtainable commercially through Armek Company Industrial Chemical Division and Eastman Chemical Company.

Dinitrotoluene (DNT) suitable for purposes of the present invention is also available commercially or obtainable as a by-product from a well-known mixed acid nitration process using toluene as starting reactant. Such process is generally described, for instance, in "Advanced Organic Chemistry", Fieser and Fieser (1961) pp 681–2.

(b) A 40–60/60–40 mixture of metriol trinitrate/-diethylene glycol dinitrate (MTN/DEGDN) is conveniently obtained, for instance, by co-nitration of the corresponding trimethylolethane and diethylene glycol with a mixture of sulfuric and nitric acids, using excess nitric acid, in the manner disclosed in U.S. Pat. No. 4,352,699 by E. H. Zeigler.

(c) Organic stabilizers suitable for use in the present invention and similar art-recognized components are commercially available, for instance, from Van de Mark Chemical Company, Inc.

Additional additive components known to the art such as sensitizers, desensitizers, gelling agents and thickening agents such as nitrocellulose or nitrocotton, woodflour, and propping agents also may be included, as desired, within compositions of the present invention to better adapt to widely varying ambient and geological conditions, and to favor efficient introduction into the water, oil, or gas-bearing strata.

The following Examples further illustrate certain preferred embodiments of the instant invention.

EXAMPLE I

Seven and three tenths (7.3) pounds of commercially obtained 99.6% dioctylphthalate from U.S. Steel Company, Industrial Chemicals Division and one-half (0.5) pound of diethyl-diphenylurea obtained commercially as "Ethyl Centralite" obtained commercially from Van de Mark Chemical Company, Inc. are admixed in a 5 gallon stainless steel reactor maintained at 20° C. by a temperature control jacket. To this mixture is slowly added 42.2 pounds of 40/60 ratio MTN/DEGDN (metriol trinitrate/diethylene glycol dinitrate) obtained in accordance with the procedures set out in U.S. Pat. No. 4,352,699 of E. H. Zeigler, and the components allowed to remain at 20° C. or about twenty (20) minutes. The resulting liquid product is found to have excellent flowability characteristics at +68° F. and molasses-like characteristics at −22° F.

The resulting composition is tested for impact sensitivity using a standard Picatinny Arsenal-type of explosive impact testing apparatus with 0.1 gm of explosive and 2 Kg impact weight, and tested for velocity of reaction, using a four (4) inch diameter charge under actual detonation conditions. For the later purpose, a detonating cord downline (25 grain/ft) is used with a 1 pound booster of commercially available high brisant explosive (7000 m/sec) for each 10 feet of test charge column. The test results are reported in Table I infra.

TABLE I

| | | | $[R''(A)O]_3[PO_4]$ | | | $ROOC(A)COOR^1$ | | $R'''(Ac)_m$*** | | | |
|---|---|---|---|---|---|---|---|---|---|---|---|
| Example | R | $R^1$ | R'' | R''' | A** | MTN/DEGDN | Ester/NA* | Stabilizer | Velocity m/sec. | m | Impact Sensitivity 50%**** |
| II | $C_4H_9$ | $C_4H_9$ | — | — | —ϕ— | 40/60 | 14/85 | Ethyl Centralite | 1200 | — | + |
| III | $C_5H_{11}$ | $C_5H_{11}$ | — | — | —ϕ— | 40/60 | 14/85 | Ethyl Centralite | 1500 | — | + |
| IV | $C_6H_{13}$ | $C_6H_{13}$ | — | — | —ϕ— | 40/60 | 14/85 | Ethyl Centralite | 1700 | — | + |
| V | $C_7H_{15}$ | $C_7H_{15}$ | — | — | —ϕ— | 40/60 | 14/85 | Ethyl Centralite | 2000 | — | + |
| I | $C_8H_{17}$ | $C_8H_{17}$ | — | — | —ϕ— | 40/60 | 14/85 | Ethyl Centralite | 2100 | — | + |
| — | $C_4H_9$ | $C_8H_{17}$ | — | — | —ϕ— | 40/60 | 14/85 | Ethyl Centralite | 2400 | — | + |
| VII | — | — | — | $C_3H_5$ | — | 40/60 | 14/85 | Ethyl Centralite | 1800 | 3 | + |
| VI | — | — | $CH_3$ | — | —ϕ— | 40/60 | 14/85 | Ethyl Centralite | 2500 | | + |
| VIII Control | — | — | — | — | — | 40/60 | — | Ethyl Centralite | 6900 | — | + |

*Ratio by weight of ester-to-nitrated polyhydric alcohol
**Phenylene nucleus
***Acetoxy group
****Exceeding 48 cm using 2 Kg weight and 0.1 gm. charge

EXAMPLE II

Example 1 is repeated using 7.3 pounds of dibutylphthalate and the test results evaluated as before and reported in Table I.

EXAMPLE III

Example 1 is repeated using 7.3 pounds of dipentylphthalate and the test results evaluated as before and reported in Table I.

EXAMPLE IV

Example 1 is repeated using 7.3 pounds of dihexylphthalate and the test results evaluated as before and reported in Table I.

EXAMPLE V

Example 1 is repeated using 7.3 pounds of diheptylphthalate and the test results reported in Table I.

EXAMPLE VI

Example I is repeated using 7.3 pounds of tricresyl phosphate in place of dioctylphthalate and the results evaluated and reported in Table I.

EXAMPLE VII

Example I is repeated using 7.3 pounds of triacetin in place of dioctylphthalate and the results evaluated and reported in Table I.

EXAMPLE VIII (CONTROL)

Example I is repeated using 0.5 pounds of Ethyl Centralite and 49.5 pounds of MTN/DEGDN but without the use of an ester "(a)" component, the results being evaluated as before and reported in Table I.

EXAMPLE IX

A gelled version of the Example I product is prepared using a brass Schrader Bowl maintained at 20° C. by gently admixing the MTN/DEGDN component (76% by weight total composition) with dioctylphthalate (11% by weight) followed by 0.5% by weight of the Ethyl Centralite stabilizer and 4% by weight of nitrocellulose (nitrocotton). After thorough mixing, the remaining ingredients, i.e. Cab-O-Sil; (0.5%), wood flour (6%) and starch (2.5%) are mixed in, and the mixture permitted to stand for 18 hours at 20° C. to gel. The resulting product is packaged in 4 inch polyethylene bags and tested for impact sensitivity (90 cm drop/2 Kg 50%) detonation and reaction velocity in the manner of Example I, the results being reported in Table II below.

EXAMPLE X

Example IX is repeated, employing 0.5% by weight of microballoons obtainable from Union Carbide, Inc., as UCAR phenolic microballoons in place of Cab-O-Sil. The packaged product is tested for impact sensitivity and reaction velocity, a 50% detonation level being obtained at slightly over 100 cm travel length, using a 2 Kg striker and 0.1 gm charge. Reaction velocity is reported in Table II below.

EXAMPLE XI (CONTROL)

Example IX is repeated without the dioctylphthalate ester component, the tests being carried out as before to obtain an impact sensitivity of 50% detonation level using a 2 Kg striker and a 0.1 gm charge at 69 cm. The reaction velocity is reported in Table II.

TABLE II

| | | | $ROOC(A)COOR^1$ | | | | | | | | |
|---|---|---|---|---|---|---|---|---|---|---|---|
| Example | R | $R^1$ | A | MTN/DEGDN Ratio by wt. | % By weight Composition | ESTER (% By wt.) | Ethyl Centralite Stabilizer | Nitro/ cotton | Wood-flour | Starch | Velocity (m/sec.) |
| IX | $C_8H_{17}$ | $C_8H_{17}$ | —ϕ— | (40/60) | 76 | 11% | 0.5% | 4% | 6% | 2.5% | 2200 |
| X | $C_8H_{17}$ | $C_8H_{17}$ | —ϕ— | (40/60) | 76 | 11% | 0.5% | 4% | 6%* | 2.5% | 1400 |

TABLE II-continued

ROOC-(A)-COOR[1]

| Example | R | R[1] | A | MTN/DEGDN Ratio by wt. | % By weight Composition | ESTER (% By wt.) | Ethyl Centralite Stabilizer | Nitro/ cotton | Wood-flour | Starch | Velocity (m/sec.) |
|---|---|---|---|---|---|---|---|---|---|---|---|
| XI (Control) | — | — | — | (40/60) | 87 | | 0.5% | 4% | 6% | 2.5% | 6900 |
| XII (Control) | — | — | — | (40/60) | 87 | — | 0.5% | 4% | 6% | 2.5% | 6900 |

*plus 0.5% microballoons

EXAMPLE XII (CONTROL)

Example X is repeated without the dioctylphthalate ester component, the tests being carried out as before to obtain an impact sensitivity of 50% detonation level using a 2 Kg striker and 0.1 gm charge at 98 cm. The reaction velocity is reported in Table II.

EXAMPLE XIII

Example I is repeated using the same amount of dibutylphthalate, and Ethyl Centralite stabilizer but replacing the MTN/DEGDN component with an equivalent amount of metriol trinitrate (MTN) alone. The resulting liquid product is then tested as before to determine velocity, total energy, and the ratio of shock (S) to bubble (G) energy obtained. The test results are reported in Table III infra.

Pennsylvania, and about one-half (0.5) pound of Ethyl Centralite stabilizer are admixed in a five (5) gallon stainless steel reactor maintained at 20° C. by a temperature control jacket. To this mixture is slowly added 27.5 pounds of pre-cooled nitroglycerin and the mixture allowed to remain at 20° C. for about twenty (20) minutes. The resulting liquid product is then tested as before to determine reaction velocity, total energy and the ratio of (S) to (G) energy obtained. The test results are reported in Table III.

*Consisting of a mixture of the 2,4- and 2,6-isomers.

EXAMPLE XVII

Example XVI is repeated except that 85% of a 40/60 ratio of MTN/DEDGN mixture is used in place of the nitroglycerin (NG) component. The test results obtained are reported in Table III.

TABLE III

ROOC-(A)-COOR' R-(A)-[$NO_2$]$_2$

| Example | R | R' | R | A** | NG* | MTN/DEGDN | Stabilizer | Velocity (m/sec.) | Energy (ft. lb/lb) | S/G (in %) |
|---|---|---|---|---|---|---|---|---|---|---|
| XIII | $C_4H_9$— | $C_4H_9$— | — | —ϕ— | — | 85/0 | Ethyl Centralite | 1600 | 8.16 | 22.1/77.9 |
| XIV | $C_4H_9$— | $C_4H_9$— | — | —ϕ— | — | 0/85 | Ethyl Centralite | 1800 | 9.36 | 34.2/65.8 |
| XV | $C_4H_9$— | $C_4H_9$— | — | —ϕ— | 75 | — | Ethyl Centralite | 2850 | 10.37 | 37.3/62.7 |
| XVI*** | — | — | $CH_3$— | —ϕ— | 55 | — | Ethyl Centralite | 1050 | 9.98 | 38.5/61.5 |
| XVII*** | — | — | $CH_3$— | —ϕ— | — | 40/60 | Ethyl Centralite | 2200 | 10.41 | 35.7/64.3 |

*Ratio by weight of ester-to-nitrated polyhydric alcohol
**Phenylene nucleus
***Blend M used

EXAMPLE XIV

Example I is repeated using the same amounts of dibutylphthalate and stabilizer but replacing MTN/DEGDN with an equivalent amount of DEGDN alone. The resulting liquid product is then tested as before to determine reaction velocity, total energy and the ratio of (S) to (G). Tests are reported in Table III.

EXAMPLE XV

Example I is repeated using the same amounts of dibutylphthalate and stabilizer but replacing MTDN/DEGDN with the equivalent amount of nitroglycerin (NG). The resulting liquid product is then tested as before to determine reaction velocity, total energy and the ratio of (S) to (G). Tests are reported in Table III.

EXAMPLE XVI

Twenty-two (22) pounds of 2,4 dinitrotoluene obtained commercially as "Dinitrotoluene Blend M"* from Air Products and Chemicals, Inc., of Allentown,

What I claim and desire to protect by Letters Patent is:

1. An explosive composition comprising (a) at least one component selected from the group consisting of

ROOC-(A)-COOR[1],

[R''-(A)-O]$_3$[$PO_4$],

R''-{A}-[$NO_2$]$_2$, and

R'''-(Ac)$_m$ in which

R and R[1] are individually defined as a lower alkyl group;

A is defined as the nucleus of a substituted or unsubstituted aromatic group;

R'' is an alkyl group of 1–2 carbon atoms;

R''' is an alkyl group of 3–8 carbon atoms;

Ac is an acetoxy group; and m is a whole number of 1–3;

(b) a component comprising at least one member selected from the group consisting of metriol trinitrate, diethylene glycol dinitrate, and nitroglycerin; and (c) an stabilizing amount of at least one organic stabilizer component;

the ratio by weight of (a) to (b) components in said composition being about 9–45 to 91–55.

2. The composition of claim 1 having as the (a) component thereof an ester wherein A is defined as a phenyl or napthyl group; R and $R^1$ are individually defined as a 4–8 carbon alkyl group; and the (b) component comprises 0–100 to 100–0 parts by weight of metriol trinitrate to diethylene glycol dinitrate.

3. An explosive composition comprising (a) at least one component of the formula $$ROOC\text{-}(A)\text{-}COOR^1,$$

$$[R''\text{-}(A)\text{-}O]_3[PO_4],$$

or $$R'''\text{-}(Ac)_m$$

wherein

R and $R^1$ are separately and individually defined as a lower alkyl group;

A is defined as the nucleus of a substituted or unsubstituted divalent aromatic group;

R'' is an alkyl group of 1–2 carbon atoms;

R''' is an alkyl group of 3–8 carbon atoms;

Ac is an acetoxy group; and m is a whole number of 1–3; with (b) a component comprising a 40–60 to 60–40 mixture by weight of metriol trinitrate to diethylene glycol dinitrate; and (c) an active amount of at least one organic stabilizer component;

the ratio by weight of (a)-to-(b) in said composition being about 9–20:91–80.

4. The composition of claim 1 having as the (a) component a component of the formulae $$[R''\text{-}(A)\text{-}O]_3[PO_4]$$

or $$R''\text{-}(A)\text{-}[NO_2]_2$$

wherein R is defined as a methyl group; A is a phenyl group; and a (b) component comprising 0–100:0–100:0–100 parts by weight of metriol trinitrate, diethylene glycol dinitrate, and nitroglycerin.

5. The composition of claim 1 utilizing metriol trinitrate as a (b) component.

6. The composition of claim 1 utilizing diethylene glycol dinitrate as a (b) component.

7. The composition of claim 1 wherein the ratio by weight of (a) to (b) is about 9–20 to 91–80.

8. The composition of claim 1 wherein the (b) component comprises a 40–60 to 60–40 mixture by weight of metriol trinitrate to diethylene glycol dinitrate.

9. The composition of claim 2 wherein R and $R^1$ are individually defined as a four carbon alkyl group; and A is a phenyl group.

10. The composition of claim 2 wherein R and $R^1$ are individually defined as a five carbon alkyl group; and A is a phenyl group.

11. The composition of claim 2 wherein R and $R^1$ are individually defined as a six carbon alkyl group; and A is a phenyl group.

12. The composition of claim 2 wherein R and $R^1$ are individually defined as a seven carbon alkyl group; and A is a phenyl group.

13. The composition of claim 2 wherein R and $R^1$ are individually defined as an eight carbon alkyl group; and A is a phenyl group.

14. The composition of claim 3 wherein R''' is a three carbon alkyl moiety and m is 2–3.

15. The composition of claim 13 wherein m is 3.

16. The composition of claim 1 wherein the organic stabilizer is diethyl-diphenylurea or 2-nitrodiphenylamine.

17. The composition of claim 2 containing diethyldiphenylurea or 2-nitrodiphenylamine as an organic stabilizer.

18. The composition of claim 4 containing diethyldiphenylurea or 2-nitrodipenylamine as an organic stabilizer.

19. The composition of claim 1 containing nitrocotton in combination with wood flour.

20. The composition of claim 1 containing a density control agent.

21. A method for minimizing the formation of a residual stress field and well bore hole damage during a well shoot operation, comprising placing at least one explosive charge of low detonation velocity of the composition of claim 1, at or about the pay zone of a well; and detonating said explosive charge in desired order to obtain a low detonation velocity explosion having an (S)-to-(G) ratio of about 5%–45% to 95%–55%.

22. A method for minimizing the formation of a residual stress field by placing and detonating at least one explosive charge of low detonation velocity of the composition of claim 2.

23. A method for minimizing the formation of a residual stress field by placing and detonating at least one explosive charge of low detonation velocity corresponding to a composition of claim 3.

24. A method for minimizing the formation of a residual stress field by placing and detonating at least one explosive charge of low detonation velocity corresponding to a composition of claim 4.

25. A method for minimizing the formation of a residual stress field by placing and detonating at least one explosive charge of low detonation velocity corresponding to a composition of claim 5.

26. A method for minimizing the formation of a residual stress field by placing and detonating at least one explosive charge of low detonation velocity corresponding to a composition of claim 6.

27. A method for minimizing the formation of a residual stress field by placing and detonating at least one explosive charge of low detonation velocity corresponding to a composition of claim 8.

28. A method for minimizing the formation of a residual stress field by placing and detonating at least one explosive charge of low detonation velocity corresponding to a composition of claim 9.

29. A method for minimizing the formation of a residual stress field by placing and detonating at least one explosive charge of low detonation velocity corresponding to a composition of claim 10.

30. A method for minimizing the formation of a residual stress field by placing and detonating at least one explosive charge of low detonation velocity corresponding to a composition of claim 19.

* * * * *